US006343548B1

(12) United States Patent
Bayer et al.

(10) Patent No.: US 6,343,548 B1
(45) Date of Patent: Feb. 5, 2002

(54) SHEET-FED PRINTING MACHINE WITH IMPROVED QUALITY CONTROL CONSOLE

(75) Inventors: Harald Bayer, Rodgau; Gerhard Augsberg, Seligenstadt; Georg Herzan, Oberursel/Taunus; Klemens Kemmerer, Seligenstadt/Main, all of (DE)

(73) Assignee: MAN Roland Druckmashinen AG (DE)

( * ) Notice: Subject to any disclaimer, the term of this patent is extended or adjusted under 35 U.S.C. 154(b) by 0 days.

(21) Appl. No.: 09/522,150

(22) Filed: Mar. 9, 2000

(30) Foreign Application Priority Data

Mar. 11, 1999 (DE) ..... 299 04 511 U

(51) Int. Cl.[7] ..... B41F 33/00; B41F 33/02

(52) U.S. Cl. ..... 101/232; 101/132; 101/141; 101/480; 101/474; 382/112; 356/244

(58) Field of Search ..... 101/232, 132, 101/141, 142, 474, 480; 382/112; 356/244

(56) References Cited

U.S. PATENT DOCUMENTS 3,936,180 A * 2/1976 Willard et al. ..... 399/10
5,029,525 A 7/1991 Jeschke ..... 101/232
5,163,012 A * 11/1992 Wuhrl et al. ..... 382/112
6,057,937 A * 5/2000 Shimizu et al. ..... 358/302

FOREIGN PATENT DOCUMENTS

| | | | |
|---|---|---|---|
| DE | 42 26 842 C1 | | 8/1992 |
| EP | 0 213 439 B1 | | 5/1991 |
| JP | 55-65558 A | * | 5/1980 |

* cited by examiner

*Primary Examiner*—Daniel J. Colilla
(74) *Attorney, Agent, or Firm*—Leydig, Voit & Mayer, LTD

(57) ABSTRACT

A sheet-fed printing machine having a control console at the downstream end of a sheet transfer system which transfers printed sheets to a delivery unit. The control console has an inclined proof sheet support surface disposed in direct overlying relation to the delivery unit and sheet transfer system upon which a proof sheet withdrawn from the delivery unit may be positioned and assessed for quality. The support surface further includes control elements for directly adjusting and controlling printing quality based upon assessment of the proof sheet. With the control console support surface in overlying relation to the sheet transfer system and the delivery unit, the support surface is at a height which can be comfortably used by an operator of average height and does not impede access to the end of the printing machine nor increase its overall length.

11 Claims, 1 Drawing Sheet

SHEET-FED PRINTING MACHINE WITH IMPROVED QUALITY CONTROL CONSOLE

FIELD OF THE INVENTION

The present invention relates generally to sheet-fed offset printing machines, and more particularly, to quality control consoles for such printing machines.

BACKGROUND OF THE INVENTION

Sheet-fed offset printing machines often have operating or trimming desks on which a proof sheet can be placed and inspected visually. Such desks generally have a sheet support surface mounted at an angle with respect to the horizontal so that a proof sheet placed on the desk can be assessed by an operator. In the case of larger sheet-fed offset printing machines, such trimming desks generally are located at a control station of the machine in the vicinity of the delivery unit upon which sheets are slacked following printing. A proof sheet removed from the delivery unit can be placed on the desk and assessed. The desk additionally can have operating controls for remote adjustment of various operating items in the printing machine, and in particular, for remotely adjusting and controlling inking zones of the machine. If the proof sheet is deposited on the desk and compared with the intended zonal inking arrangement, for example, the operator can make inking changes in the respective ink metering zones to effect the necessary correcting adjustments.

German patent DE 42 26 842 C1 discloses and apparatus for controlling an offset printing machine with a delivery unit of the machine having an operating panel which can be moved between operating and parked positions. The operating panel includes devices which enable remote control of the printing apparatus, including remote zonal ink control. In the operating position, the operating panel is at a height which corresponds approximately to the top of the delivery stack. If the operating panel is no longer needed, it may be folded down and located downstream of the delivery stack.

A disadvantage of such prior apparatus is that accessibility to the deliver stack is impaired. In particular, in the case of small format sheet-fed offset printing machines in which predominantly small editions are printed, the delivery stack, and therefore the entire delivery unit is not very high, so that the operating panel arranged in the foregoing manner as a proof sheet support cannot be arranged at an ergonomically desirable height for the operator.

German patent EP0 213 439 B1 discloses a sheet-fed offset printing machine with a chain delivery sheet conveyor and a control desk, with the control desk having a support surface for proof sheets directly downstream of the delivery stack in the sheet running direction. By means of an appropriately designed proof sheet removal device, the sheets to be inspected can be placed directly on top of the desk. The desk likewise has controls for remote operating adjustments, and in particular for adjustment of remote inking zones.

The disadvantage in this case is that, as in the aforementioned apparatus, accessibility to the delivery stack is impaired. The deliver stack no longer can be changed from the end of the machine in the direction of sheet transport, and the overall length of the machine is increased.

OBJECTS AND SUMMARY OF THE INVENTION

It is an object of the present invention to provide a sheet-fed printing machine having an easy to use control panel which does not obstruct access to the deliver unit of the printing machine. Another object is to provide a sheet-fed printing machine as characterized above in which the control panel does not increase the overall length of the printing machine.

A further object is to provide an offset printing machine of the above kind in which the control panel has a test sheet support surface that is at a comfortable height for the operator to use.

Still another object is to provide an offset printing machine of the foregoing type in which the control console is relatively simple in construction and lends itself to economical manufacture.

The invention is carried out by a console having a test sheet support surface disposed over the delivery stack at a height at which sheets can be comfortably viewed by an operator of average height. The sheet support surface has a size that even a larger sheet format processed through the machine can be deposited on it.

According to a preferred embodiment of the invention, the sheet support surface of the control console has an inclination with respect to the horizontal, the angle of inclination preferably being between 30 and 45 degrees. In such embodiment of the invention, stops or a stop rail are located adjacent the bottom of the support surface so that a deposited sheet can be aligned on the stop rail.

According to a further preferred embodiment of the invention, adjustable stops are provided on the support surface for supporting a deposit sheet in aligned relation to its zonal metering format. This embodiment preferably is used when control devices are provided along a lower end of the support surface for permitting adjustment in remote inking zones of the printing machine. Hence, after a proof sheet has been delivered onto a delivery stack under the support surface and then deposited on the support surface, an operator can inspect the quality and correct it as necessary through adjustment in the appropriate ink metering zones.

According to still a further preferred embodiment of the invention, the sheet support surface includes a lighting device adapted for providing a glare free and reflection free illumination of sheets deposited on the inclined sheet support surface.

The control console of the present invention allows for simple and comfortable observation of proof sheets even in low stack delivery units in which the delivery stack has a relatively low height. The deposit surface is disposed above the delivery stack and preferably arranged at a height of about one meter above the floor and preferably at an angle of between 30 and 45 degrees with respect to the horizontal. An operator of average height can thereby remove a printed sheet transferred to the underlying delivery stack and easily place it on the deposit or support surface of the control console. By means of an appropriate alignment element or elements, which can be adjusted on the support surface in accordance with the inking format of the sheet, the proof sheet can be aligned in accordance with the ink metering zones of the printing machine. If the support surface includes further operating and indicating elements or controls, in addition to operating elements for the adjustment of the remote inking zones, essentially the entire printing process can be monitored and controlled from the location of the delivery unit.

Moreover, since the support surface for the sample sheets is arranged above the delivery stack, the overall length of the machine is not increased. With the support surface of proof sheets inclined in the foregoing manner, electrical and/or mechanical components of the machine or additional equipment further can be accommodated in the space between the underside of the support surface and the chain sheet transfer conveyor for the delivery unit.

Other objects and advantages of the invention will become apparent upon reading the following detailed description and upon reference to the drawings, in which:

Figure 1:
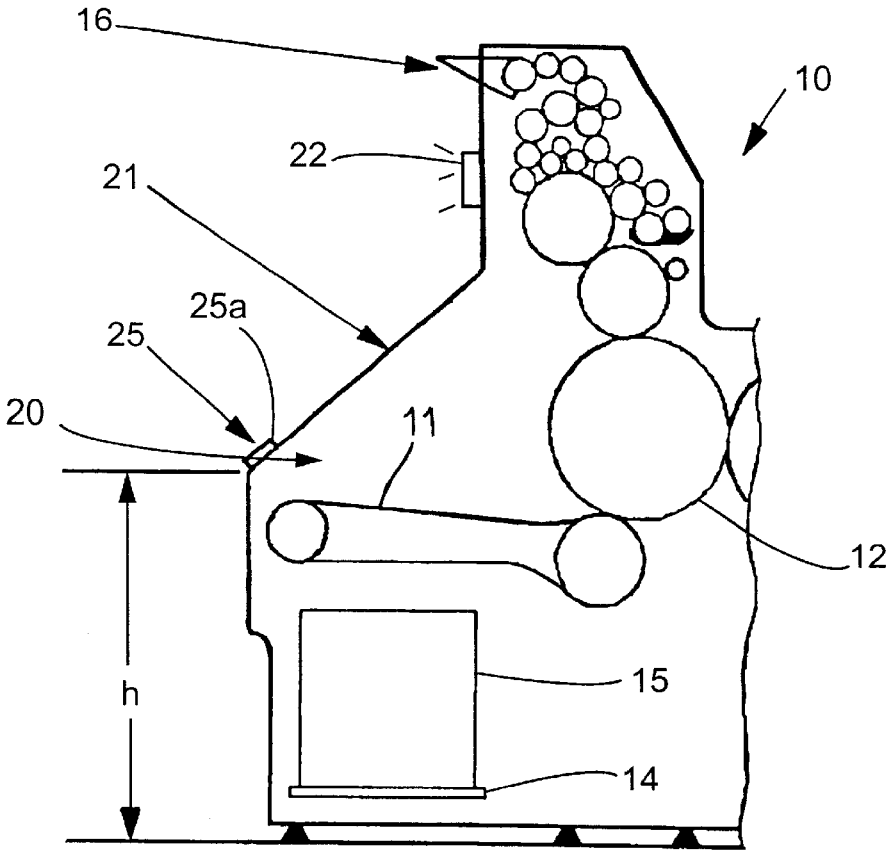
FIG. 1 a diagrammatic side elevation depiction of the delivery end of a sheet-fed printing machine having a control console in accordance with the invention.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENT

Referring now more particularly to the drawings, there is shown the last printing unit 10 of an illustrative sheet-fed printing machine in accordance with the invention. By means of a sheet transfer system 11, such as a conventional chain conveyor, sheets can be removed from an impression cylinder 12 of the last printing unit 10, and transferred to a delivery unit 14 at the end of the sheet transfer system 11 where the sheets are deposited in a sheet stack 15. It will be understood that each printing unit 10 of the printing machine includes an ink metering system 16 which have adjustable elements that can be remotely controlled in a known manner. FIG. 1 shows the ink metering system 16 of the last printing unit 10.

In accordance with the invention, a control console is provided at the end of the ink transfer system which includes a proof or test sheet support surface disposed in directly overlying relation to the delivery unit and sheet transfer system such that a test sheet from the underlying sheet stack may be conveniently withdrawn from the delivery unit and positioned on the test surface for easy quality assessment. To this end, in the illustrated embodiment, a console 20 is provided at the end of the sheet transfer system 11, which has a proof sheet support surface 21 disposed in inclined relation to the horizontal. It will be understood that devices or equipment of a known type may be used for automatically withdrawing proof sheets from the delivery stack 15 and positioning the sheets onto the sheet support surface 21. The support surface 21 preferably is located at a height "h" of about 1 meter above the floor at the downstream end of the machine in the sheet flow direction and inclines upwardly in an upstream direction at an angle preferably between about 30 and 45 degrees. An operator of average height can thereby comfortably stand adjacent the end of the support surface and evaluate proof sheets. A lighting device 22 in this case is provided for generating a glare free and reflection free illumination of sheets deposited on the inclined support surface.

In keeping with the invention, arranged along a lower end of the support surface 21 is a row of operating or control elements 25, preferably in the form of pairs of push buttons, operable in a known manner for remotely adjusting and controlling the inking zones of the printing machine. Hence, by means of the operating or control elements 25, the remotely adjustable elements of the ink metering systems 16 of the individual printing units of the machine can be activated and/or adjusted.

Figure 2:
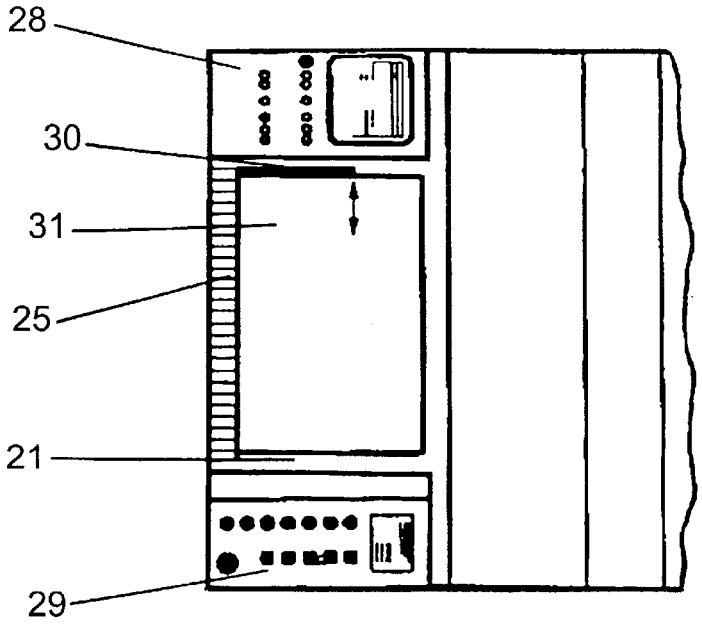
FIG. 2 is a top plan view of the printing machine shown in FIG. 1.

Preferably, further operating or control elements 28, 29, are located on opposite lateral sides of the support surface 21 for enabling remote and adjustable control of further operating aspects of the printing machine. The operating or control elements 28, 29 additionally can include indicating elements, by means of which such values can be indicated and adjustments can be performed under an appropriate menu control. In carrying out a further aspect of the invention, the operating elements 25 for the individual ink metering zones are disposed along a lower end of the support surface 21 so as to serve as a stop and support ledges for the proof sheet deposited on the support surface 21. As shown in FIG. 1, the operating elements 25 are disposed along a straight line, such that the upper upstanding surfaces 25*a* thereof are in a horizontal line and define a support against which the test sheet may be positioned. An adjustable aligning element 30, furthermore, is provided at one end of the operating elements 25, namely the left side end as viewed in FIG. 2, for enabling a proof sheet 31 deposited on the support surface 21 to be in predetermined assigned relation to the metering zones of the machine in accordance with the intended inking format. In this way, inking which is determined at a specific location on the proof sheet 31 and is to be corrected can be assigned directly to the corresponding metering zone and corrected by means of operation of the appropriately aligned push button operating elements 25.

From the foregoing, it can be seen that while the control console 20 is at the end of the sheet transfer system 11 for the last printing unit 10, it does not increase the overall length of the printing machine, nor prevent access to the end of the printing machine. Moreover, since the support surface 21 is located above both the delivery unit 14 and the sheet transfer system, namely the chain conveyor in the illustrated embodiment, it is at a height which can be comfortably used by an operator of average height. With the support surface 21 upwardly inclined in an upstream direction over the deliver unit and sheet transfer chain conveyor, electrical and/or mechanical components of the machine or additional equipment can be accommodated in the space between the underside of the support surface 21 and the sheet transfer system 11 if needed. While the support surface 21 is disposed in direct overlying relation to the delivery unit and the sheet stack, it nevertheless has a relatively simple construction and lends itself to economical manufacture and sufficient usage.

What is claimed is:

1. A sheet-fed printing machine comprising at least one printing unit having an adjustably controlled ink metering system, a sheet transfer system for transferring printed sheets to a delivery unit and positioning the printed sheets in a sheet stack, a control console at the end of said sheet transfer system, said control console having a flat proof sheet support surface disposed in direct overlying relation to said delivery unit upon which a proof sheet withdrawn from the sheet stack of the underlying delivery unit may be positioned for unobstructed viewing in assessing printing quality and said support surface having control elements for adjustably controlling the ink metering system.

2. The sheet-fed printing machine of claim 1 in which said control elements are located on said support surface adjacent the location sheets are deposited on said support surface.

3. The sheet-fed printing machine of claim 2 in which said support surface is disposed at an angle to the horizontal.

4. The sheet-fed printing machine of claim 3 in which said support surface is disposed at an angle of between about 30 degrees and 45 degrees to the horizontal.

5. The sheet-fed printing machine of claim 1 in which said control elements are disposed along a lower end of said support surface.

6. The sheet-fed printing machine of claim 5 including an alignment element located to the side of the control elements against which a proof sheet can be positioned corresponding to zonal ink metering requirements.

7. The sheet-fed printing machine of claim 6 in which said alignment element is an adjustable stop.

8. The sheet-fed printing machine of claim 1 including a lighting device for illuminating the support surface.

9. A sheet-fed printing machine comprising at least one printing unit having an adjustably controlled ink metering system, a sheet transfer system for transferring printed sheets to a delivery unit downstream of said at least one printing unit, and for positioning the printed sheets in a sheet stack, a control console at the end of said sheet transfer system, said control console having a proof sheet support surface disposed in direct overlying relation to said delivery unit upon which a proof sheet withdrawn from the sheet stack of the underlying delivery unit may be positioned and assessed for quality, control elements for adjustably controlling said ink metering system, and said control elements being disposed in a horizontal row along a lower end of said support surface for defining a support for a proof sheet positioned on said support surface.

10. A sheet-fed printing machine comprising a sheet transfer system for transferring printed sheets to a delivery unit at the end of a sheet transfer system and for positioning the printed sheets in a sheet stack; a control console at the end of said sheet transfer system; and said control console having a proof sheet support surface disposed in direct overlying relation to said delivery unit, angling upwardly to the horizontal in an upstream direction, upon which a proof sheet withdrawn from the sheet stack of the underlying delivery unit may be positioned and assessed for quality.

11. The sheet-fed printing machine of claim 10 in which said support surface has a downstream end elevated at a height of about 1 meter.

* * * * *